US009257781B2

(12) United States Patent
Pade

(10) Patent No.: US 9,257,781 B2
(45) Date of Patent: Feb. 9, 2016

(54) TIGHT-SEALING EMBODIMENT OF A PLUG

(71) Applicant: Wolfgang Pade, Illingen (DE)

(72) Inventor: Wolfgang Pade, Illingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/309,455

(22) Filed: Jun. 19, 2014

(65) Prior Publication Data

US 2014/0377974 A1 Dec. 25, 2014

(30) Foreign Application Priority Data

Jun. 19, 2013 (DE) ..... 10 2013 211 454

(51) Int. Cl.
*H01R 13/52* (2006.01)

(52) U.S. Cl.
CPC ..... *H01R 13/5208* (2013.01)

(58) Field of Classification Search
USPC ..... 439/271, 275, 587, 589
See application file for complete search history.

(56) References Cited

U.S. PATENT DOCUMENTS

| | | | | |
|---|---|---|---|---|
| 5,931,699 | A * | 8/1999 | Saito | 439/587 |
| 7,033,216 | B2 * | 4/2006 | Ito | 439/587 |
| 7,637,764 | B2 * | 12/2009 | Yoneda et al. | 439/275 |
| 8,267,720 | B2 * | 9/2012 | Ishida | 439/587 |
| 8,734,174 | B2 * | 5/2014 | Nakamura | 439/271 |

* cited by examiner

*Primary Examiner* — Alexander Gilman
(74) *Attorney, Agent, or Firm* — Kenyon & Kenyon LLP

(57) ABSTRACT

A plug is provided for producing an electrical connection with a plug module, such as a wiring harness plug for creating an electrical connection with a control device in a motor vehicle. The plug includes a plug body that has a multiplicity of channels for accommodating electrical lines; a mat seal that has a multiplicity of channels for guiding electrical lines accommodated in the channels of the plug body and that is situated on the at least one laterally circumferential radial seal in order to seal the plug; and a pressure plate that has a multiplicity of channels for guiding electrical lines accommodated in the channels of the plug body.

11 Claims, 6 Drawing Sheets

TIGHT-SEALING EMBODIMENT OF A PLUG

FIELD OF THE INVENTION

The present invention relates to a plug for producing an electrical connection with a plug module, such as a wiring harness plug for a control unit in a motor vehicle.

BACKGROUND OF THE INVENTION

In a vehicle, in the engine compartment and in the body compartment numerous electrical and electronic control devices are installed that have to be electrically connected to one another and to further components of the vehicle such as sensors and actuators.

For this purpose, a control device can be equipped with a plug module on whose multipoint connector there may be situated a few hundred electrical contacts, for example for power supply and for a transmission of signals. A corresponding plug connected to a wiring harness can be plugged onto the plug module in order to create the electrical connection.

In order to protect the electrical contacts of the plug and the plug module against what may include aggressive media and deposits in the engine compartment, plugs for control devices are produced from a plurality of individual components and are equipped for example with sealing mats, or mat seals. At the edges of these mat seals, there may be attached radial seals, for example in the form of sealing lips, which are realized for the purpose of sealing the plug and protecting the electrical contacts.

However, tightness problems have been observed in plugs, in particular after being connected and disconnected numerous times, which can lead for example to shortened lifespans of the plug connectors and/or to malfunctioning.

SUMMARY

Specific embodiments of the present invention advantageously make it possible to provide a plug for a wiring harness of a vehicle in a tight-sealing embodiment that increases the lifespan of the plug connection, improves sealing tightness, and/or can be produced in a simplified production process.

According to a specific embodiment of the present invention, the plug has a plug body that has a multiplicity of channels for accommodating electrical lines. In addition, the plug has a mat seal that has a multiplicity of channels for guiding the electrical lines accommodated in the channels of the plug body, and on which at least one laterally circumferential radial seal is situated in order to seal the plug. In addition, the plug has a pressure plate that has a multiplicity of channels for guiding the electrical lines accommodated in the channels of the plug body.

The mat seal and the pressure plate can be placed into a receptacle region of the plug body so that the channels of the pressure plate, of the mat seal, and of the plug body each open into one another and form continuous channels for accommodating the electrical lines. Here, the channels define an axial direction of the plug.

The receptacle region of the plug body has a boundary that annularly surrounds the mat seal and the pressure plate, so that the radial seal of the mat seal is situated between the boundary of the receptacle region and the mat seal.

Overall, the plug can be realized so as to provide an electrical connection between a wiring harness and a control unit that is long-lived and reliable due to the tight-sealing construction of the plug.

For this purpose, the pressure plate and the mat seal are fashioned so as to cooperate with one another such that when the mat seal and the pressure plate are placed into the receptacle region of the plug body through a displacement of the pressure plate in the axial direction an edge region of the mat seal is spread in a radial direction so that the radial seal of the mat seal is pressed against the boundary of the receptacle region, radially sealing the plug. Here, the radial direction runs orthogonal to the axial direction.

Ideas for specific embodiments of the present invention can be regarded as being based on the observations described below: up to now, as a rule a relatively large force has had to be applied in order to place the mat seal into the receptacle region of the plug body, because the radial seal is pressed in sealing fashion against the boundary of the receptacle region of the plug body already during placement of the mat seal. The high plugging forces of the mat seal sometimes have the result that during mounting of the plug the radial seal is damaged, for example crushed, torn, or shorn away. As a result, sealing problems are observed in plugs, so that the electrical contacts inside the plug are no longer adequately protected.

Through the cooperating realization according to the present invention of the pressure plate and the mat seal, it can be ensured that the radial seal of the mat seal can no longer be damaged during assembly of the plug, because the radial seal is not pressed against the boundary of the receptacle region until the pressure plate is placed into the receptacle region of the plug body. In this way, a sealing function of the mat seal can be ensured and the mounting of the mat seal is advantageously simplified, because the mat seal can be mounted in the plug body in sealing fashion with a low exertion of force.

According to a specific embodiment of the present invention, the edge region of the mat seal, which is spread by the displacement of the pressure plate, is fashioned at least in a partial area as an inclined surface that inclines up to the boundary of the receptacle region of the plug body. The inclined surface is fashioned so as to introduce a force acting in the radial direction into the edge region of the mat seal upon displacement of the pressure plate in the axial direction, so that the edge region can be pressed against the plug body, in particular against the boundary of the receptacle region.

According to a specific embodiment of the present invention, the pressure plate has an edge region that is fashioned, as a press-on surface, so as to cooperate with the inclined surface of the edge region of the mat seal, and has, at least in a partial area, an incline differing from the inclined surface of the mat seal.

In this way, it can be ensured that the edge region of the mat seal can be spread by the edge region of the pressure plate and can be pressed with the radial seal against the boundary of the receptacle region of the plug body, so that the radial seal of the mat seal seals the plug in the radial direction.

According to a specific embodiment of the present invention, the mat seal has at least two radial seals for sealing the plug that are situated between the boundary of the receptacle region of the plug body and the mat seal, one of the radial seals being fashioned in such a way that when the mat seal is placed into the receptacle region of the plug body it is pressed against the boundary of the receptacle region, holding the mat seal in a position.

Through the holding of the mat seal at the provided position, the mounting of the plug can be made easier and the sealing function of the mat seal can be ensured. In addition, in this way it can be ensured that the channels of the mat seal, of the pressure plate, and of the plug body open into one another, so that the electrical lines can be guided through the channels in sealing fashion. Due to the fact that only one radial seal is pressed radially into the receptacle region of the plug body during the mounting of the mat seal, and the second radial seal is not pressed radially against the receptacle region until the pressure plate is mounted, in addition damage to the radial seals resulting from the mounting can be avoided. This can also result in a savings of production costs, because there will be fewer rejected mat seals.

According to a specific embodiment of the present invention, the mat seal is fashioned asymmetrically with regard to a side facing the pressure plate and a side facing away from the pressure plate. In other words, the mat seal is not symmetrical relative to a plane normal to the axial direction; i.e., it is fashioned asymmetrically in the axial direction.

The idea of the asymmetrical embodiment of the mat seal can be regarded as being based on the following described observations: the channels in the mat seal used for the guidance of lines can be situated at various positions in the mat seal. Here, the channels are often not distributed uniformly; i.e. in particular they can be situated asymmetrically in the mat seal. Up to now, mat seals have in general been fashioned symmetrically with regard to their external contour, for which reason they have to be sorted during production because otherwise there is a danger that a mat seal will be mounted so as to be reversed with regard to its sides. A mat seal mounted in side-reversed fashion can however result in an untight plug, which can reduce the reliability and lifespan of the plug connection.

Through the asymmetrical embodiment of the mat seal according to the present invention, it can be advantageously ensured that during production of the plug the correct installation position of the mat seal can be recognized, for example by hand or by a robot. This can result in a further reduction in production costs, because on the one hand a sorting of the mat seal can be omitted, and on the other hand the number of plugs rejected as untight can be reduced.

According to a specific embodiment of the present invention, a circumference of the mat seal on the side facing the pressure plate is larger than on the side facing away from the pressure plate. This can facilitate placement of the mat seal into the receptacle region of the plug body, because the mat seal can easily be placed in the provided position. In addition, in this way the sealing of the plug can additionally be ensured because the radial seal, already pressed against the boundary of the plug body during placement of the mat seal, can be pressed securely onto the boundary of the receptacle region without being damaged during this operation, due to the correct installation position of the mat seal. Thus, in addition the rejection of untight plugs in production, and therewith the production costs, can be further reduced.

According to a specific embodiment of the present invention, the mat seal has a sealing body on the side facing away from the pressure plate. The sealing body can for example be made of an elastic material applied flatly on the side of the mat seal facing away from the pressure plate, or can for example be realized as an element running circumferentially around the axial direction. That is, the sealing body can for example be realized in the form of a surface seal, or can cover only a partial area of the side of the mat seal facing away from the pressure plate. In addition, the mat seal can be fashioned in one piece with the sealing body, or the sealing body can be fashioned as a separate component, for example in the form of a mat having corresponding channels for guiding the electrical lines.

According to a specific embodiment of the present invention, the sealing body of the mat seal is fashioned so as to be pressed against the plug body in the axial direction during the displacement of the pressure plate in the axial direction, thus sealing the plug in the axial direction. In this way, the plug can advantageously additionally be sealed in the axial direction without requiring further production costs.

According to a specific embodiment of the present invention, the sealing body and/or the circumferential radial seals of the mat seal are made of a silicone material. As a soft and tough material, silicone can advantageously be suitable for this purpose, because it can be exposed to high pressure loads and tensile forces without tearing or being damaged. However, other elastic sealing materials, such as Viton, can also be used as radial seals and sealing bodies.

An aspect of the present invention relates to a plug system having a plug and a plug module that accepts the plug. The plug system can for example be used to produce an electrical connection between a wiring harness and a control device in a motor vehicle. Here, the plug module can be attached to the control device and the plug can be connected to the wiring harness of the vehicle.

DETAILED DESCRIPTION

Figure 1:
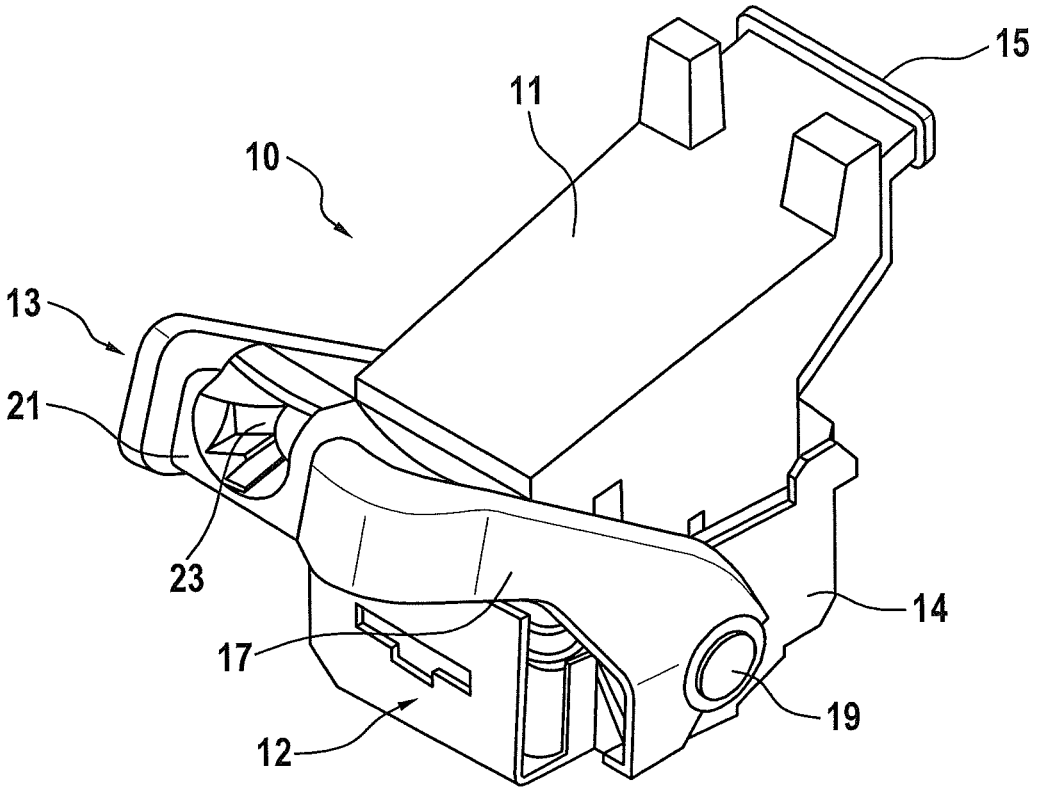
FIG. 1 shows a perspective view of a plug according to a specific embodiment of the present invention.

FIG. 1 shows a plug 10 having a plug cover 11, a plug lever 13, and a plug body 12. Plug body 12 has a plug base 14 that can be plugged onto plug module 25 in order to produce an electrical connection with a plug module 25 (see FIG. 4). Plug cover 11 has a receptacle opening 15 via which electrical lines of a wiring harness can be guided into plug body 12.

Plug lever 13 surrounds plug body 12 in a U shape with two arms 17, on each of whose ends there is situated a shaft 19. The two shafts 19 are received on two opposite sides of plug base 14. Arms 17 are connected to a cross-beam 21 in which a plug lock 23 is attached.

Plug lever 13 is fashioned so as to be moved from a starting position to an end position and at the same time to pull plug 10 into plug module 25. In FIG. 1, plug lever 13 is shown in the end position, plug lock 23 for securing the electrical connection being locked to plug module 25.

Figure 2:
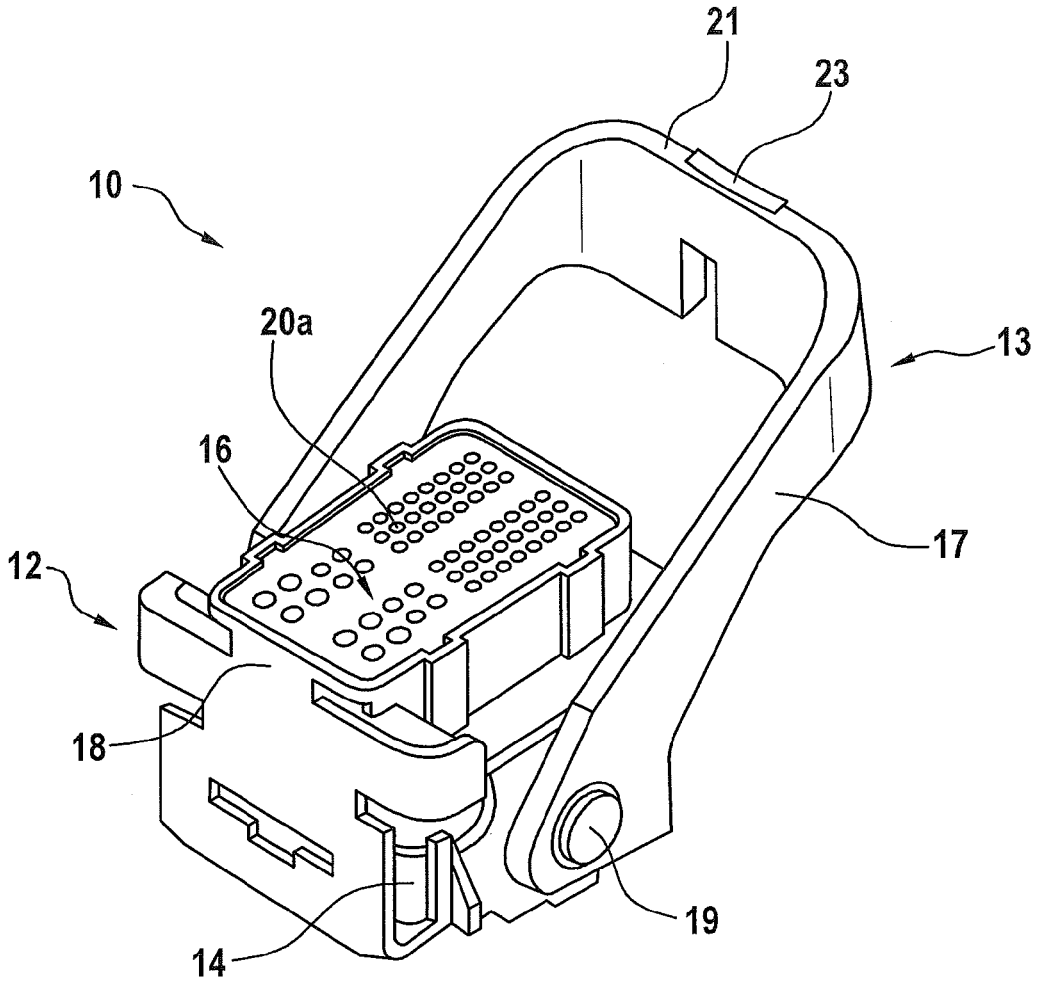
FIG. 2 shows a perspective view of a part of the plug of FIG. 1.

FIG. 2 shows plug 10 without plug cover 11, and plug lever 13 is shown in the starting position. A pressure plate 16 is placed into a receptacle region 18 of plug body 12, pressure plate 16 having channels 20*a* for guiding electrical lines into plug body 12.

Figure 3:
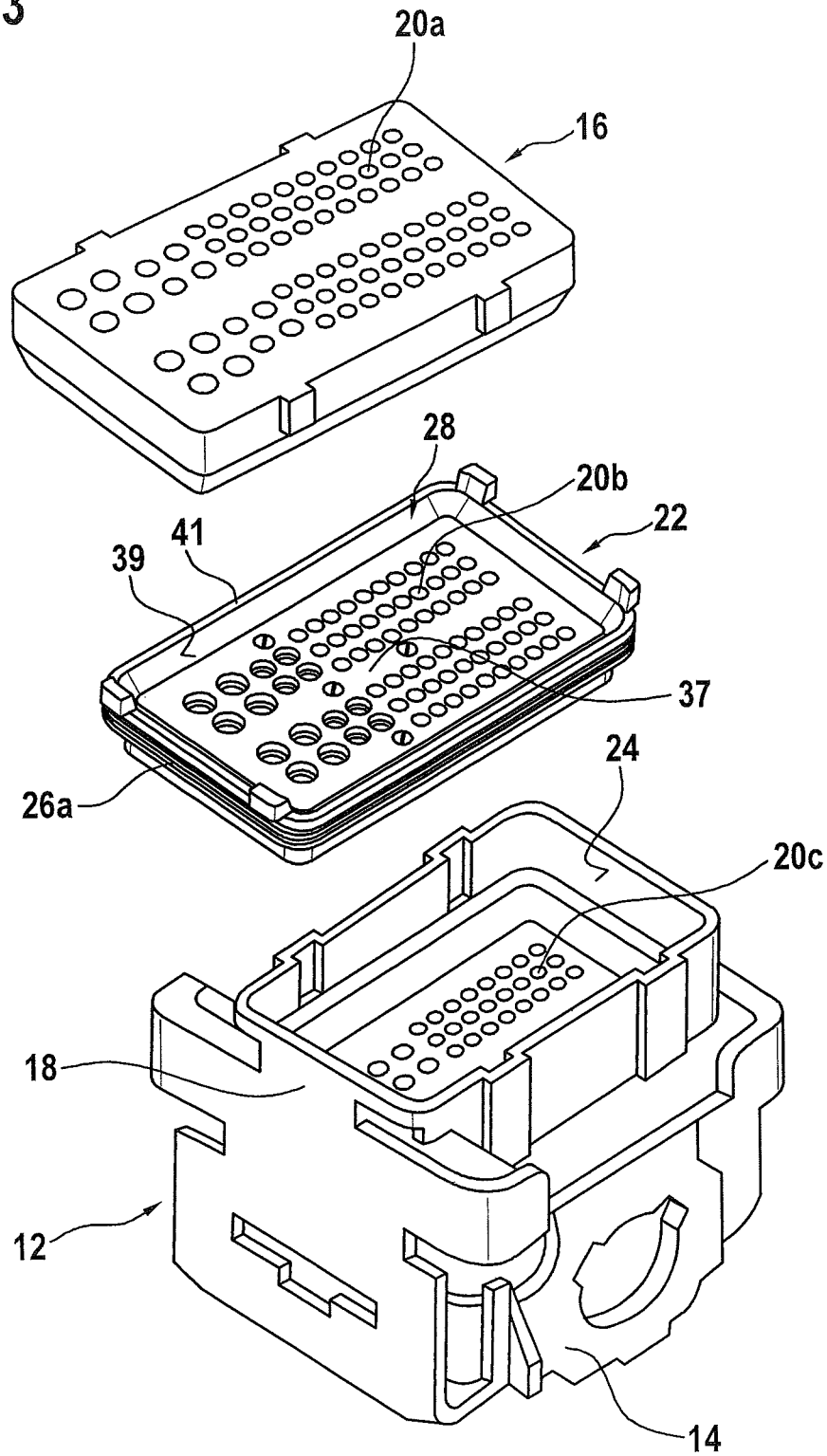
FIG. 3 shows an exploded view of the part of the plug of FIG. 2.

FIG. 3 shows plug 10 without plug cover 11 and without plug lever 13, in an exploded view. In receptacle region 18 of plug body 12, a mat seal 22 can be placed between plug body 12 and pressure plate 16.

Mat seal 22 has channels 20*b* for the sealed guidance of electrical lines. If pressure plate 16 and mat seal 22 are placed into receptacle region 18 of plug body 12, then channels 20*a* of pressure plate 16 open into channels 20*b* of mat seal 22, and channels 20*b* of mat seal 22 in turn open into channels 20*c* of plug body 12, so that continuous channels 20*a*, 20*b*, 20*c* are formed. The electrical lines of a wiring harness can in this way be guided via receptacle opening 15 of plug cover 11 through continuous channels 20*a*, 20*b*, 20*c* into plug body 12 in order to produce an electrical connection with a plug module 25. In this way, the course of channels 20*a*, 20*b*, 20*c* defines an axial direction of plug 12.

Plug body 12, pressure plate 16, and mat seal 22 can each have channels having different diameters that can be used for the guidance or accommodation of electrical lines having different diameters, such as lines for power supply and/or lines for a transmission of signals.

Mat seal 22 has in addition an upper radial seal 26*a* for sealing plug 10 that laterally surrounds mat seal 22, i.e. that surrounds mat seal 22 laterally in a plane orthogonal to the axial direction. Receptacle region 18 of plug body 12, into which mat seal 22 and pressure plate 16 can be placed, has a boundary 24 that surrounds mat seal 22 and pressure plate 16 in annular fashion so that upper radial seal 26*a* is situated between boundary 24 of receptacle region 18 and a central region 37, having channels 20*b*, of mat seal 22.

Figure 4:
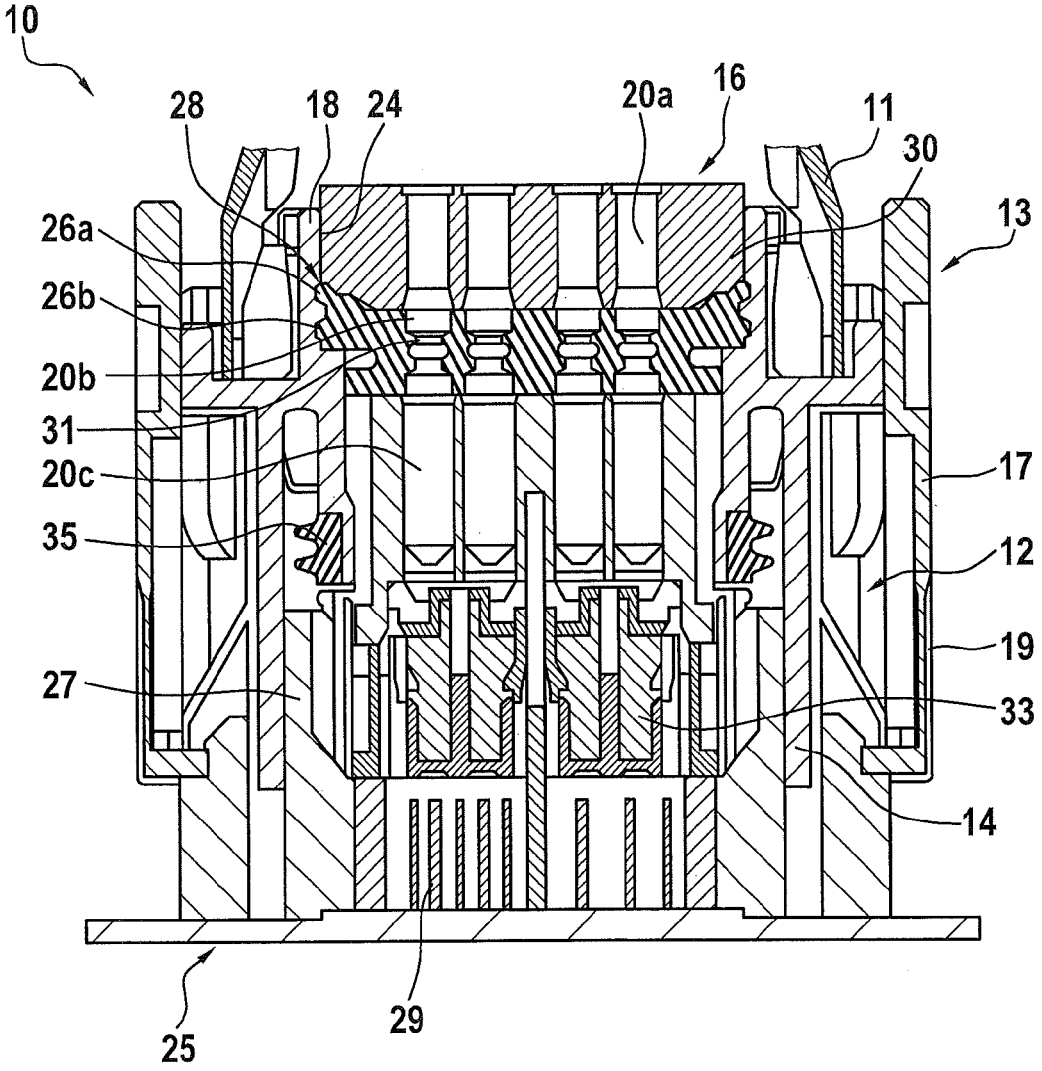
FIG. 4 shows a cross-section through a plug system according to a specific embodiment of the present invention.

FIG. 4 shows plug 10 in a cross-section along a center plane that runs parallel to the axial direction, pressure plate 16 and mat seal 22 being placed into receptacle region 18 of plug body 12, so that channels 20*a* of pressure plate 16, channels 20*b* of mat seal 22 and channels 20*c* of plug body 12 open into one another, forming continuous channels 20*a*, 20*b*, 20*c* for guiding the electrical lines. Channels 20*b* of mat seal 22 also have a tapering region 31 that is fashioned to seal the electrical lines inside mat seal 22.

Alternatively or in addition to tapering region 31, channels 20*b* of mat seal 22 can have elastic elements (not shown), for example made of silicone, that can be situated inside the channels and that surround the electrical lines in sealing fashion in their routing through mat seal 22. Pressure plate 16 and plug body 12 themselves can also have a tapering region and/or elastic elements inside channels 20*c*, 20*a* for the sealing guidance of the electrical lines.

To produce an electrical connection between the electrical lines accommodated in plug body 12 and electrical contacts 29 of a plug module 25, plug 10 is placed onto plug module 25, plug module 25 having a collar 27 that is accommodated by plug base 14. Plug body 12 has in addition a plug element 33 that is fashioned so as to accommodate electrical contacts 29 of plug module 25.

In addition, a circumferential sealing element 35 is situated around plug base 14, the sealing element being realized so as to be accommodated between collar 27 of plug module 25 and plug base 14, so that plug 10 plugged onto plug module 25 is sealed relative to a surrounding environment.

Pressure plate 16 and mat seal 22 are fashioned so as to cooperate in such a way that when they are placed into receptacle region 18 of plug body 12 through displacement of pressure plate 16 in the axial direction an edge region 28 of mat seal 22 is spread in the radial direction, so that upper radial seal 26*a* of mat seal 22 is pressed against boundary 24 of receptacle region 18, and plug body 12 is sealed.

Edge region 28 of mat seal 22 is fashioned, at least in a partial area, as an inclined surface 39 inclining upward to boundary 24 of receptacle region 18. So that edge region 28 of mat seal 22 can be spread by the displacement of pressure plate 16 in order to seal plug 10, pressure plate 16 has an edge region 30 that is fashioned as a press-on surface cooperating with inclined surface 39 of edge region 28 of mat seal 22, and has, at least in a partial area, an incline differing from inclined surface 39 of edge region 28 of mat seal 22.

Underneath upper radial seal 26*a* of mat seal 22, mat seal 22 has a lower radial seal 26*b* that also runs laterally around the circumference of mat seal 22. Lower radial seal 26*b* is already pressed against boundary 24 of receptacle region 18 when mat seal 22 is placed into receptacle region 18, so that mat seal 22 is held in a position in which channels 20*b* open into channels 20*c* of plug body 12. In addition, plug 10 is sealed by lower radial seal 26*b* of mat seal 22.

Figure 5:
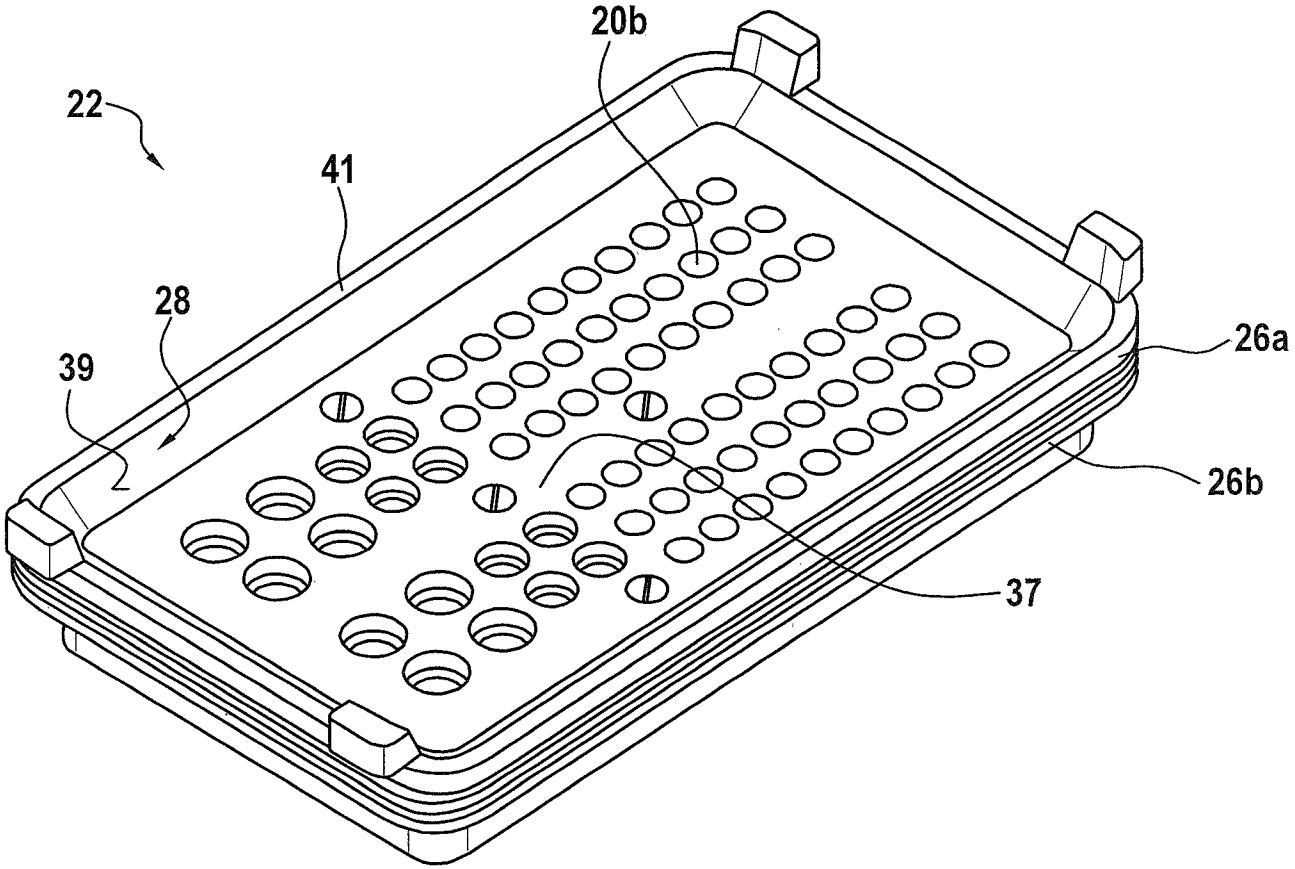
FIG. 5 shows a perspective view of a mat seal according to a specific embodiment of the present invention.

FIG. 5 shows a perspective detail view of mat seal 22 in which edge region 28, fashioned so as to cooperate with pressure plate 16, can be seen clearly. Here, edge region 28 is fashioned, in a partial area surrounding central region 37, as inclined surface 39, inclined surface 39 inclining up to boundary 24 of receptacle region 18 of plug body 12 and being fashioned so as to cooperate with edge region 30 of pressure plate 16. Edge region 30 of pressure plate 16 here has, at least in a partial region, an incline differing from inclined surface 39 of edge region 28 of mat seal 22, so that when pressure plate 16 is displaced in the axial direction a radial force component acts on edge region 28 of mat seal 22 and this edge region is spread radially, so that upper radial seal 26*a* is pressed against boundary 24 of plug body 12.

Alternatively, edge region 28 of mat seal 22 can also for example be formed in steps or as a vertical spreadable surface running parallel to the axial direction. In such a specific embodiment, edge region 30 of pressure plate 16 is then correspondingly fashioned so that edge region 28 of mat seal 22 is spread by a displacement of pressure plate 16 in the axial direction to boundary 24 of receptacle region 18 of plug body 12, and upper radial seal 26*a* can be pressed against boundary 24.

In addition, inclined surface 39 of edge region 28 of mat seal 22 is surrounded by a horizontal surface 41 that forms the outermost edge of mat seal 22. When pressure plate 16 is displaced in the axial direction, via horizontal surface 41 and via central region 37 an axial force component acts on mat seal 22, so that the overall mat seal 22 is pressed in the axial direction against plug body 12.

Figure 6:
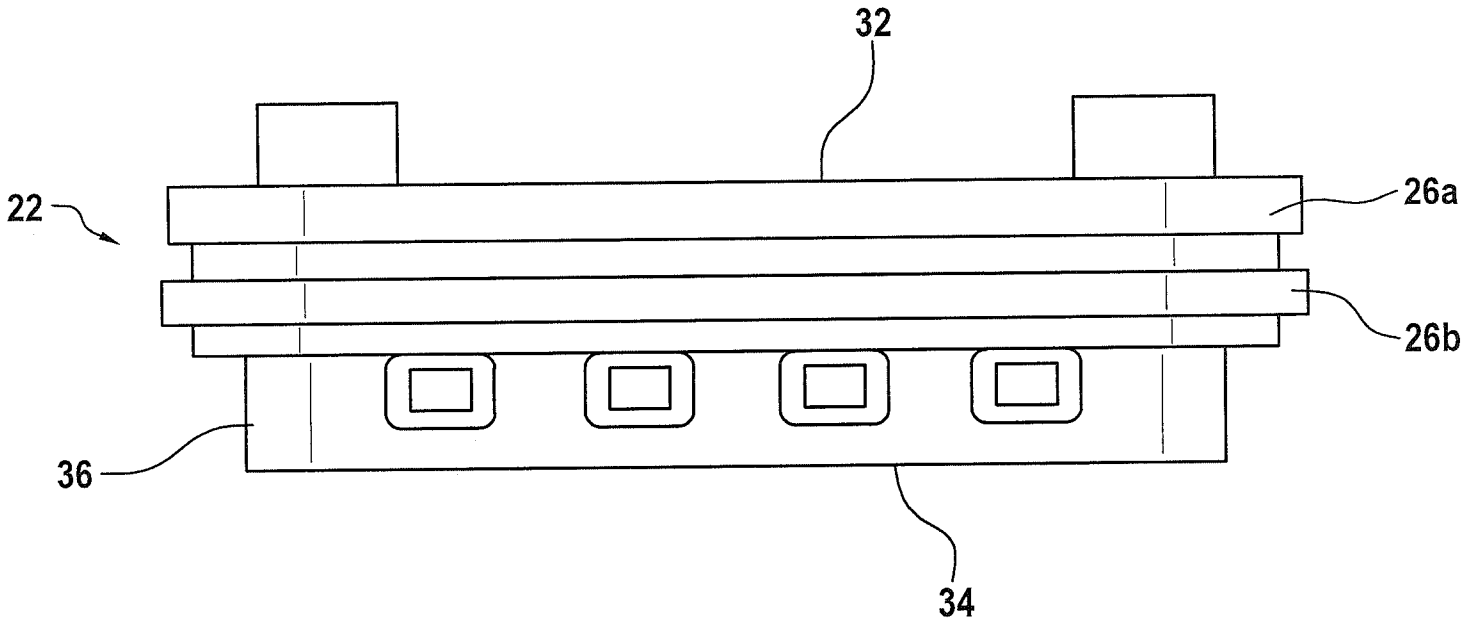
FIG. 6 shows a side view of the mat seal of FIG. 5.

FIG. 6 shows a side view of mat seal 22 of FIG. 5, in which the two radial seals 26*a*, 26*b* can be seen clearly. Upper radial seal 26*a* protrudes somewhat less from edge region 28 of mat seal 22 then does lower radial seal 26*b*. As a result, when mat seal 22 is placed into plug body 12, but before pressure plate 16 is moved axially downward, upper radial seal 26*a* is not pressed, or is pressed only slightly, against boundary 24 of receptacle region 18, and only lower radial seal 26*b* is pressed completely against boundary 24 of receptacle region 18.

In addition, mat seal 22 is made asymmetrically with reference to a side 32 facing pressure plate 16 and a side 34 facing away from pressure plate 16; i.e., mat seal 22 is not symmetrical relative to a plane normal to the axial direction. Here, mat seal 22 has a circumference that is larger on side 32 facing pressure plate 16 than on side 34 facing away from pressure plate 16.

In addition, mat seal 22 has, on side 34 facing away from pressure plate 16, a sealing body 36 that is fashioned as a sealing element running around the axial direction. As described above, when pressure plate 16 is displaced in the axial direction, an axial force is introduced into mat seal 22 via horizontal surface 41 of edge region 28 of mat seal 22 and via central region 37 of mat seal 22, so that the entire mat seal 22, and in particular sealing body 36, is pressed against plug body 12, axially sealing plug 10.

Sealing body 36, as well as radial seals 26*a*, 26*b*, can be made of silicone and can be connected fixedly, i.e. in particular in one piece, to mat seal 22. Alternatively, radial seals 26*a*, 26*b* can be fashioned for example in the form of O-rings that can be placed around mat seal 22, for example in recesses that run laterally in the circumference of mat seal 22. In addition, it is also possible for only one of radial seals 26*a*, 26*b* to be connected fixedly to mat seal 22, and for the other radial seal to be fashioned as an O-ring.

In addition, it is to be noted that "having" does not exclude any other elements, and "one" or "a" does not exclude a plurality. In addition, it is to be noted that features described with reference to one of the above exemplary embodiments can also be used in combination with other features of other exemplary embodiments described above.

What is claimed is:

1. A plug for producing an electrical connection with a plug module, the plug comprising:

a plug body that has a multiplicity of channels for accommodating electrical lines;

a mat seal that has a multiplicity of channels for guiding electrical lines accommodated in the channels of the plug body, and on which at least one laterally circumferential radial seal is situated for sealing the plug; and a pressure plate that has a multiplicity of channels for guiding electrical lines accommodated in the channels of the plug body, wherein:

the plug body includes a receptacle region into which the mat seal and the pressure plate can be placed, so that the channels of the pressure plate, of the mat seal, and of the plug body respectively open into one another, forming continuous channels for accommodating electrical lines, and at the same time defining an axial direction of the plug, the receptacle region includes a boundary that surrounds the mat seal and the pressure plate in annular fashion, so that the radial seal of the mat seal is situated between the boundary of the receptacle region and of the mat seal, and the pressure plate and the mat seal are realized in cooperating fashion in such a way that through a displacement of the pressure plate in the axial direction an edge region of the mat seal is spread in a radial direction utilizing an inclined surface of the mat seal and the pressure plate, so that the radial seal of the mat seal is pressed against the boundary of the receptacle region, sealing the plug.

2. The plug as recited in claim 1, wherein the edge region of the mat seal, spread by the displacement of the pressure plate, is fashioned at least in a partial area as the inclined surface inclining up to the boundary of the receptacle region of the plug body.

3. The plug as recited in claim 2, wherein the pressure plate includes an edge region fashioned as a press-on surface cooperating with the inclined surface of the edge region of the mat seal, and includes, at least in a partial region, an incline differing from the inclined surface of the edge region of the mat seal.

4. The plug as recited in claim 1, wherein at least two radial seals are situated on the mat seal in order to seal the plug, the radial seals being situated between the boundary of the receptacle region of the plug body and the mat seal, one of the radial seals being fashioned in such a way that when the mat seal is placed into the receptacle region the radial seal is pressed against the boundary of the receptacle region, holding the mat seal in a position.

5. The plug as recited in claim 1, wherein the mat seal is fashioned asymmetrically relative to a side facing the pressure plate and a side facing away from the pressure plate.

6. The plug as recited in claim 5, wherein the mat seal is larger, with regard to a circumference, on the side facing the pressure plate than on the side facing away from the pressure plate.

7. The plug as recited in claim 1, wherein the mat seal includes a sealing body on a side facing away from the pressure plate.

8. The plug as recited in claim 7, wherein the sealing body of the mat seal is fashioned in order to be pressed in the axial direction against the plug body when the pressure plate is displaced in the axial direction, sealing the plug.

9. The plug as recited in claim 7, wherein at least one of the sealing body and circumferential radial seals of the mat seal are made of a silicone.

10. A plug system, comprising:

a plug; and a plug module for accepting the plug, wherein the plug includes:

a plug body that has a multiplicity of channels for accommodating electrical lines;

a mat seal that has a multiplicity of channels for guiding electrical lines accommodated in the channels of the plug body, and on which at least one laterally circumferential radial seal is situated for sealing the plug; and a pressure plate that has a multiplicity of channels for guiding electrical lines accommodated in the channels of the plug body, wherein:

the plug body includes a receptacle region into which the mat seal and the pressure plate can be placed, so that the channels of the pressure plate, of the mat seal, and of the plug body respectively open into one another, forming continuous channels for accommodating electrical lines, and at the same time defining an axial direction of the plug, the receptacle region includes a boundary that surrounds the mat seal and the pressure plate in annular fashion, so that the radial seal of the mat seal is situated between the boundary of the receptacle region and of the mat seal, and the pressure plate and the mat seal are realized in cooperating fashion in such a way that through a displacement of the pressure plate in the axial direction an edge region of the mat seal is spread in a radial direction utilizing an inclined surface of the mat seal and the pressure plate, so that the radial seal of the mat seal is pressed against the boundary of the receptacle region, sealing the plug.

11. The plug as recited in claim 1, wherein before the pressure plate is displaced in the axial direction with pressure, the radial seal of the mat seal is not pressed in a sealing fashion against the boundary of the receptacle region of the plug body as it is pressed at most slightly against the boundary of the receptacle region, and only after the pressure plate is displaced in the axial direction with pressure is the edge region of the mat seal spread in a radial direction, so that the radial seal of the mat seal is pressed against the boundary of the receptacle region, sealing the plug.

* * * * *